United States Patent [19]

Surkamp et al.

[11] 4,354,531

[45] Oct. 19, 1982

[54] ROTATION DOBBY

[75] Inventors: Paul Surkamp, Kempen; Heinz Sonnenberg, Viersen, both of Fed. Rep. of Germany

[73] Assignee: Maschinenfabrik Carl Zangs Aktiengesellschaft, Krefeld, Fed. Rep. of Germany

[21] Appl. No.: 185,709

[22] Filed: Sep. 10, 1980

[30] Foreign Application Priority Data

Sep. 22, 1979 [DE] Fed. Rep. of Germany ..... 2938451

[51] Int. Cl.[3] ..... D03C 1/00

[52] U.S. Cl. ..... 139/66 R

[58] Field of Search ..... 139/66 R-74, 139/76

[56] References Cited

U.S. PATENT DOCUMENTS 1,256,644 2/1918 Barlow ..... 139/66 R

FOREIGN PATENT DOCUMENTS 2041555 3/1972 Fed. Rep. of Germany ..... 139/76
2841278 11/1979 Fed. Rep. of Germany .... 139/66 R
2841279 11/1979 Fed. Rep. of Germany .... 139/66 R
1405184 5/1965 France ..... 139/66 R
320577 1/1972 U.S.S.R. ..... 139/66 R

*Primary Examiner*—James Kee Chi
*Attorney, Agent, or Firm*—Martin A. Farber

[57] ABSTRACT

This invention relates to a rotation dobby having a key coupling between a drive shaft and an eccentric device for the movement of the heddles, the key being mounted under spring action in a radially extending recess in an eccentric disk arranged in a crank arm and being engageable and disengageable in accordance with a pattern into and out of an axially extending groove of the drive shaft at two diametrically opposite coupling places by means of a shift rod which can be controlled in accordance with a pattern and engages via a coupling member into a groove of the key which is open in the axial direction of the drive shaft. In order to simplify the engagement and disengagement, the key is pressed, in engaged position, by a compression spring into the groove of the drive shaft, the spring force of the spring being greater than the centrifugal force which acts on the key during revolution, two spring-loaded lock slides which receive the outer end of the disengaged key between them being provided on each crank arm at each coupling place.

11 Claims, 12 Drawing Figures

ROTATION DOBBY

This invention relates to a rotation dobby having a key coupling between a drive shaft and an eccentric device for the movement of the heddles, the key being supported in a radially extending recess in an eccentric disk arranged in a crank arm and being engageable and disengageable in accordance with a pattern into and out of an axially extending groove of the drive shaft at two diametrically opposite coupling places by a shift rod which is controllable in accordance with a pattern and engages with a coupling member into a groove of the wedge which is open in the axial direction of the drive shaft and a control for said rotation dobby.

From West German AS 2 036 643 and 2 036 644 a rotation dobby having a key coupling is known in which the key is guided in axial and radial directions on a ring which is controlled in accordance with a pattern and in addition in radial direction on approximately semicircular guide rails which are mounted under spring action on the connecting rod for the movement of the heddles. In this known key coupling the guide rails are moved back and forth with the connecting rod, to which they are fastened. As a result of the relative movement of the guide rails with respect to the axis of rotation of the drive shaft which is inherent in this construction, a precise engagement and disengagement of the key is no longer assured upon high speeds of rotation of the loom.

From the two West German AS 2 036 643 and 2 036 644 there is also known a control for the key which cooperates with a . . . from a needle work . . . via a swingably supported shift arm (sic) which arm engages by means of a closed ring into a groove in the key. This control has the disadvantage that upon replacement of the closed ring disassembly of the drive shaft is necessary. This is a time-consuming job which results in the loom being shut down for a long time.

Finally, from West German OS 1 535 207 there is also known a sinker control for a dobby in which the sinkers are controlled by sinker supports hanging from control levers and in which every two pressing needles are connected via a balance lever with a control lever. With this known sinker control the result is obtained that the control lever and thus the sinker holder and the sinkers suspended from it do not carry out two successive movements when, upon sinker change, the one needle passes into the working position and the other needle into the position of rest but rather remain at rest since the opposite movements of the two pressing needles counteract each other. In this way, the time which is required for the control of the sinkers can be considerably reduced. Use is made of this known sinker control in the present invention.

Based thereon, the object of the invention is to create a rotation dobby having a key coupling and a control adapted thereto which assures a dependable engagement and disengagement of the key even at high speeds of revolution and cannot be destroyed in case of improper switchings.

This object is achieved in the manner that the key, in engaged position, is pressed by a compression spring into the groove of the drive shaft, the force of said spring being greater than the centrifugal force acting on the key upon revolution, and that two spring-biased lock slides are arranged on each crank arm at each coupling place, the lock slides receiving between them the outer end of the disengaged key.

A rotation dobby developed in accordance with the invention has the advantage that special structural elements for the guiding of the key upon its revolution, for instance the known spring-mounted approximately semicircular guide rails and the closed ring used for the control or the guide ring forming part of the prior art are no longer necessary. These structural parts for the guiding and control of the key upon its revolution namely represent parts subject to wear, the maintenance and possible exchange of which is difficult since they surround the drive shaft. It has been found that the engaged key upon its revolution is held fast reliably between the drive shaft and the eccentric disk if the compression spring is sized in the manner claimed. The lock slides, which in accordance with the invention are arranged on each crank arm, have the purpose of holding the disengaged key fast, in a well-defined coupling position and are arranged, easy for maintenance, on the crank arm.

In one practical embodiment, it has proven advisable to arrange the lock slides in such a manner that their direction of movement forms an angle $\alpha$ of 3° to 95° and preferably about 25° with the coupling direction of the key. It has furthermore proven advisable to arrange the lock slides somewhat countersunk in recesses in the crank arm from which they extend by means of slide-on surfaces which form an angle $\beta$ of 80° to 170° and preferably 101° with the coupling direction of the wedge.

The lock slides can both be displaceable in axial direction and supported swingably on a fixed shaft in the crank arm.

In accordance with another feature of the invention, in a control for the rotation dobby of the present type, the shift rods for the coupling members can be formed as double-armed levers and be connected with each other via a control rod which is pushed back under spring pressure into its initial position, the control rod being supported for displacement in axial direction and cooperating via a balance lever with a known needlework.

A control developed in accordance with the invention has the advantage that both in intermittent and in continuous operation high speeds of the loom can be obtained. Furthermore, a control developed in accordance with the invention is characterized by the fact that it makes available the advantages of the known principle of design of the sinker control with a balance lever for control on a key coupling and cannot be destroyed in case of erroneous operation.

With the above and other objects and advantages in view, the present invention will become more clearly understood in connection with the detailed description of preferred embodiments, when considered with the accompanying drawings, of which:

Figure 1:
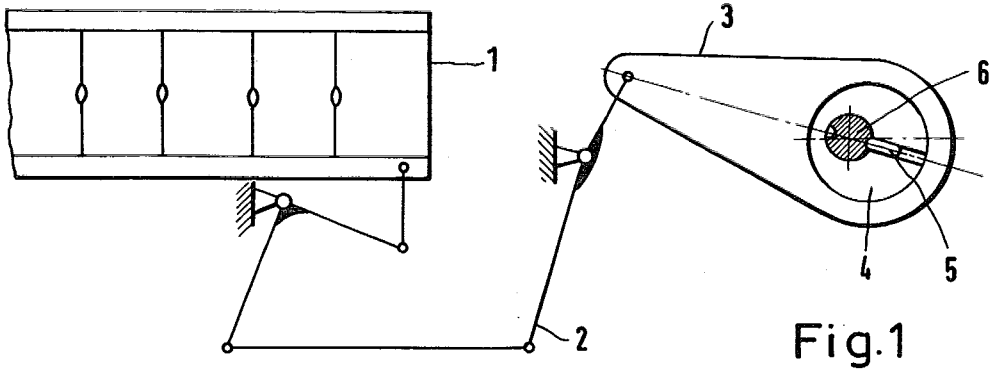
FIG. 1 is a diagram of a heddle drive in the lower shed position.
Figure 2:
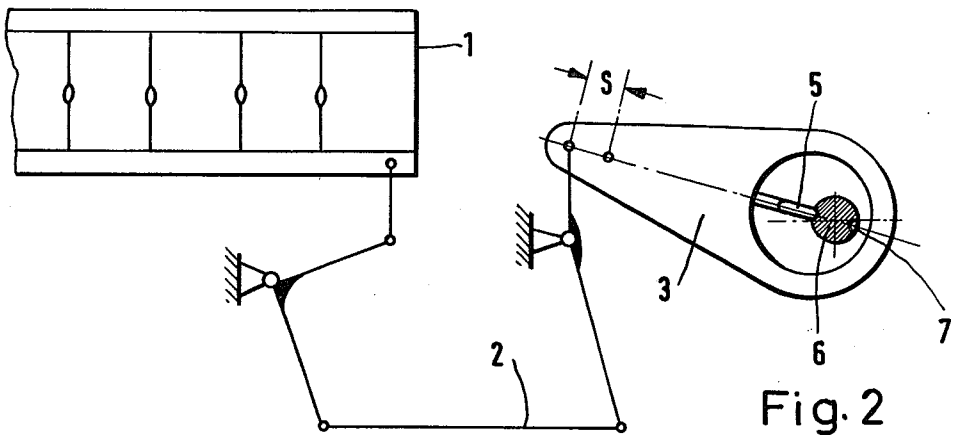
FIG. 2 is a diagram of a heddle drive in the upper shed position.
Figure 3:
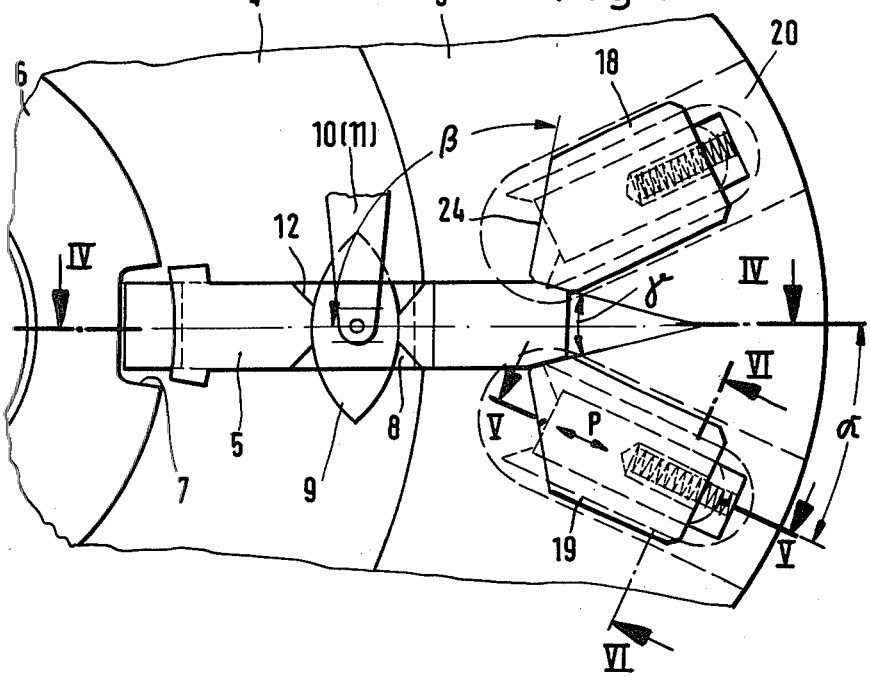
FIG. 3 shows a key coupling in side view.
Figure 4:
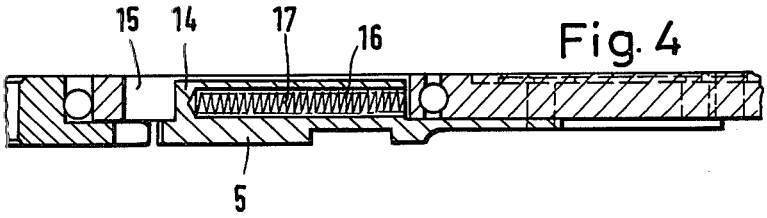
FIG. 4 shows the same key coupling in section along the line IV—IV of FIG. 3.
Figure 6:
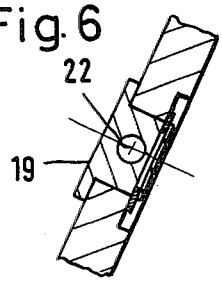
FIG. 6 shows the same lock slide in section along the line VI—VI of FIG. 3.
Figure 5:
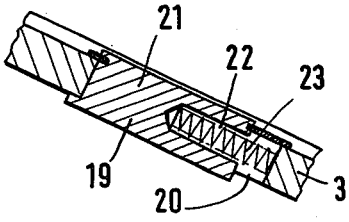
FIG. 5 shows a lock slide in section along the line V—V of FIG. 3.

A heddle 1 is moved via a rod system 2 by a crank arm 3 which is supported on an eccentric disk 4 from the lower-shed position shown in FIG. 1 into the upper shed position shown in FIG. 2, or vice versa. For this purpose, the eccentric disk 4 can be coupled by means of a radially displaceable key 5 with a drive shaft 6 which has two diametrically opposite axially extending grooves 7 for engagement of the key 5. The eccentric disk 4 which is coupled to the drive shaft 6 by means of the key 5 moves the crank arm 3 upon half a revolution, by the distance S out of the lower shed position into the upper shed position or vice versa.

The key 5 has an axially open groove 8 into which there engage coupling members 9 which are fastened to the end of the two diametrically opposite shift bars 10 and 11 which are developed as double-armed levers and can be controlled in accordance with a pattern. The inlet and outlet of the groove 8 in the wedge 5 are provided with inclined surfaces 12 while the coupling member 9 is provided with cam surfaces 13 in order to assure an undisturbed running on and off of the key 5.

On its rear, each key 5 is provided with an attachment 14 which engages into a radially extending recess 15 of the cam disk 4 and is provided with a blind borehole 16 into which a compression spring 17 is placed. The key 5 is pushed by the compression spring 17 in the direction towards the groove 7 in the drive shaft 6 and pressed into the latter upon its revolution.

After entrance into the coupling region the key 5 is pulled by the coupling member 9, against the action of the compression spring 17, out of the groove 7 of the drive shaft 6 and thus disengaged. The engaging of the key 5 into the groove 7 of the drive shaft 6 is effected by a correspondingly reversed stroke of the coupling member 9 and by the compression springs 17.

In the embodiment shown in FIGS. 3 to 6, the key is fixed in its disengaged position, into which it has been pushed by the coupling member 9, between two lock slides 18 and 19. Each lock slide 18, 19 is arranged recessed in a recess 20 of the crank arm 3 and is provided in an attachment 21 with a blind borehole 22 for a compression spring 23.

The direction of movement P of the lock slides 18, 19 forms an angle $\alpha$ of about 25° with the direction of coupling of the key 5.

On its upper side, extending out of the surface of the crank arm 3, each lock slide 18, 19 has a slide-on surface 24 which forms an angle $\beta$ of about 101° with the direction of coupling of the key 5.

The directions of movement P of the two lock slides 18, 19 and the direction of their slide-on surfaces 24 are so adapted to each other with respect to the direction of coupling of the key 5 that both, upon the forward direction of rotation and the rearward direction of rotation of the drive shaft 6, easy, uncomplicated disengagement and stopping of the key 5 is assured.

Figures 7, 8:
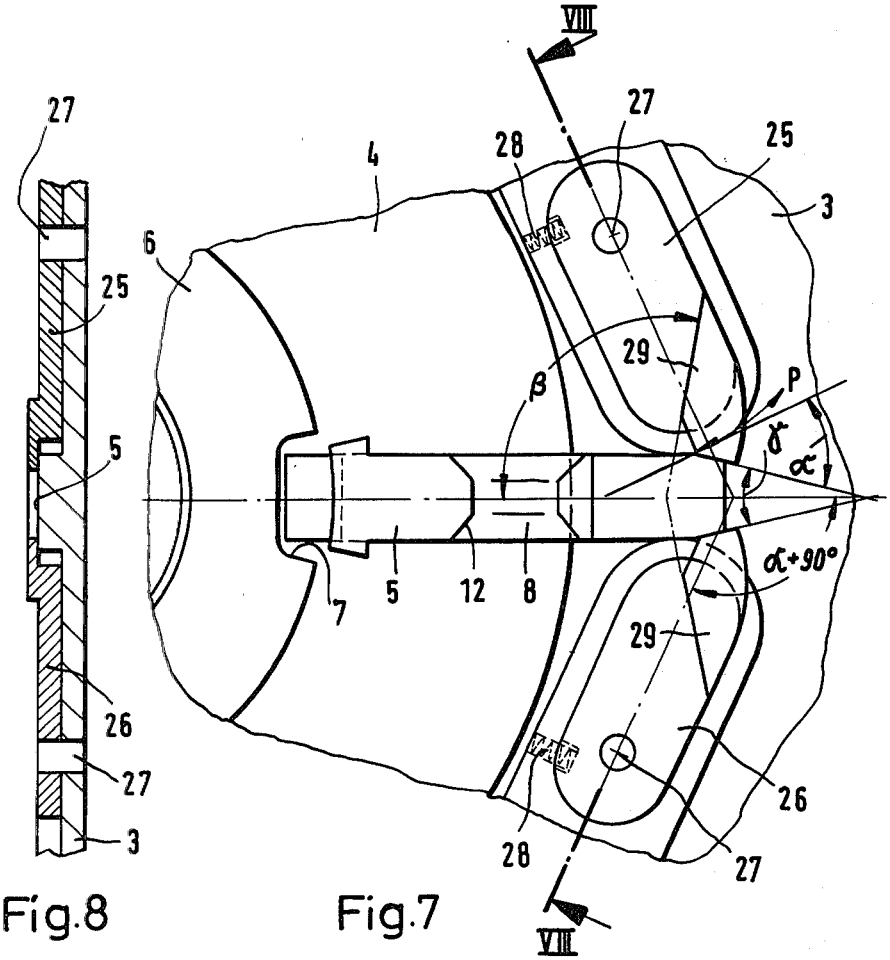
FIG. 7 shows the key coupling with a different embodiment of the lock slides in side view.
FIG. 8 shows the lock slides in section along the line VIII—VIII of FIG. 7.

In the embodiment shown in FIGS. 7 and 8, the disengaged key is held fast between two lock slides 25, 26 which are mounted on pins 27 fastened in the crank arm and can be swung against the action of compression springs 28. The lock slides 25, 26 also have slide-on surfaces 29 which intersect the coupling direction of the key 5 at the same angle $\beta$ and also move away in the direction of movement P, as in the other embodiment.

In both embodiments in accordance with FIGS. 3 to 6 or 7 and 8, the side walls facing the key 5 of the lock disks 18, 19 and 25, 26, in the same way as the outer end of the key, are beveled and arranged at an angle $\gamma$ of about 30° to each other so that the key 5 is always held in the same disengaged position.

The two shift rods 10 and 11 are swingably supported on fixed shafts 31, 32 and connected at their outer ends via slide bearings 33 with a control rod 34 which in its turn is connected with a balance lever 35. To the balance lever 35 there are pivoted two sinkers 36 which are connected with sensing needles 37 which scan a paper card (not shown) which is moved by a card cylinder 38. A hole in the paper card means that the sensing needles 37 drop into it and move the sinkers 36 into the path of movement of knives 39.

The control rod 34 is pulled into its starting position by a compression spring 40 which abuts against a bearing bracket 41 and a projection 42. On both sides of the slide bearings 33 for the two shift rods 10 and 11 there are also arranged on the control rod 34 projections 43 to 46 with the interposition of compression springs 47 and 48 in order to transmit the result of the scanning from the paper card to the coupling device for the wedge 5. The balance lever cooperates with two abutments 49 and 50.

Figure 9:
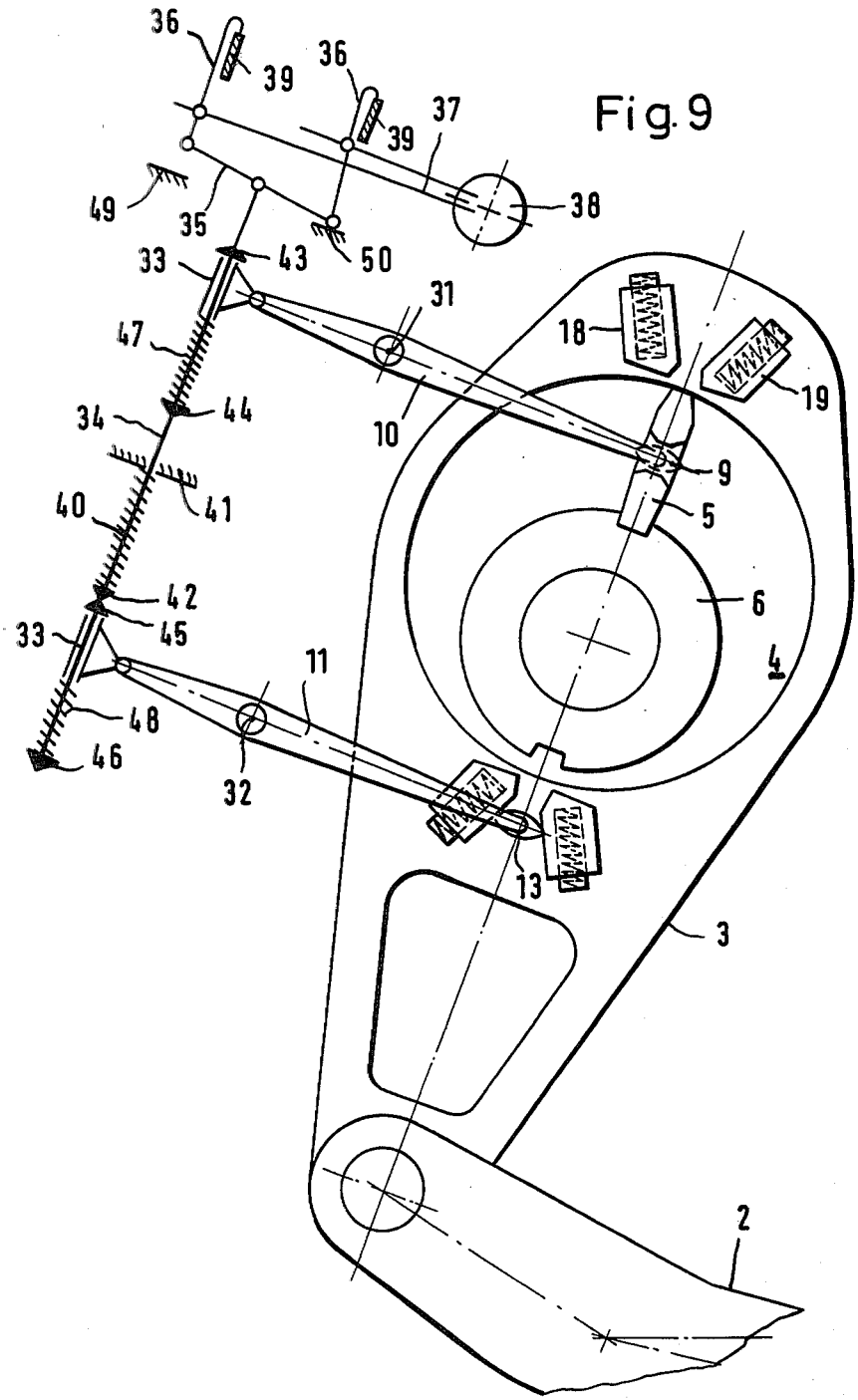
FIGS. 9 to 12 are diagrammatic showings of a control for the key coupling for the movement of the heddles from the lower shed into the upper shed or vice versa and for holding the heddles in the lower shed or in the upper shed, as seen in side view.

The control shown in FIGS. 9 to 12 for a key coupling developed in accordance with the invention is very simple in its construction and operates in the following manner:

In the lower-shed position shown in FIG. 9, the sensing needles 37 have found a hole in the paper card so that the sinkers 36 have lifted the balance lever 35 from its abutment 49 and thereby swung the shift rod 10 in such a manner that the key 5 has been engaged in the drive shaft 6. The corresponding heddle is then moved from the lower shed position into the upper shed position.

Figure 10:
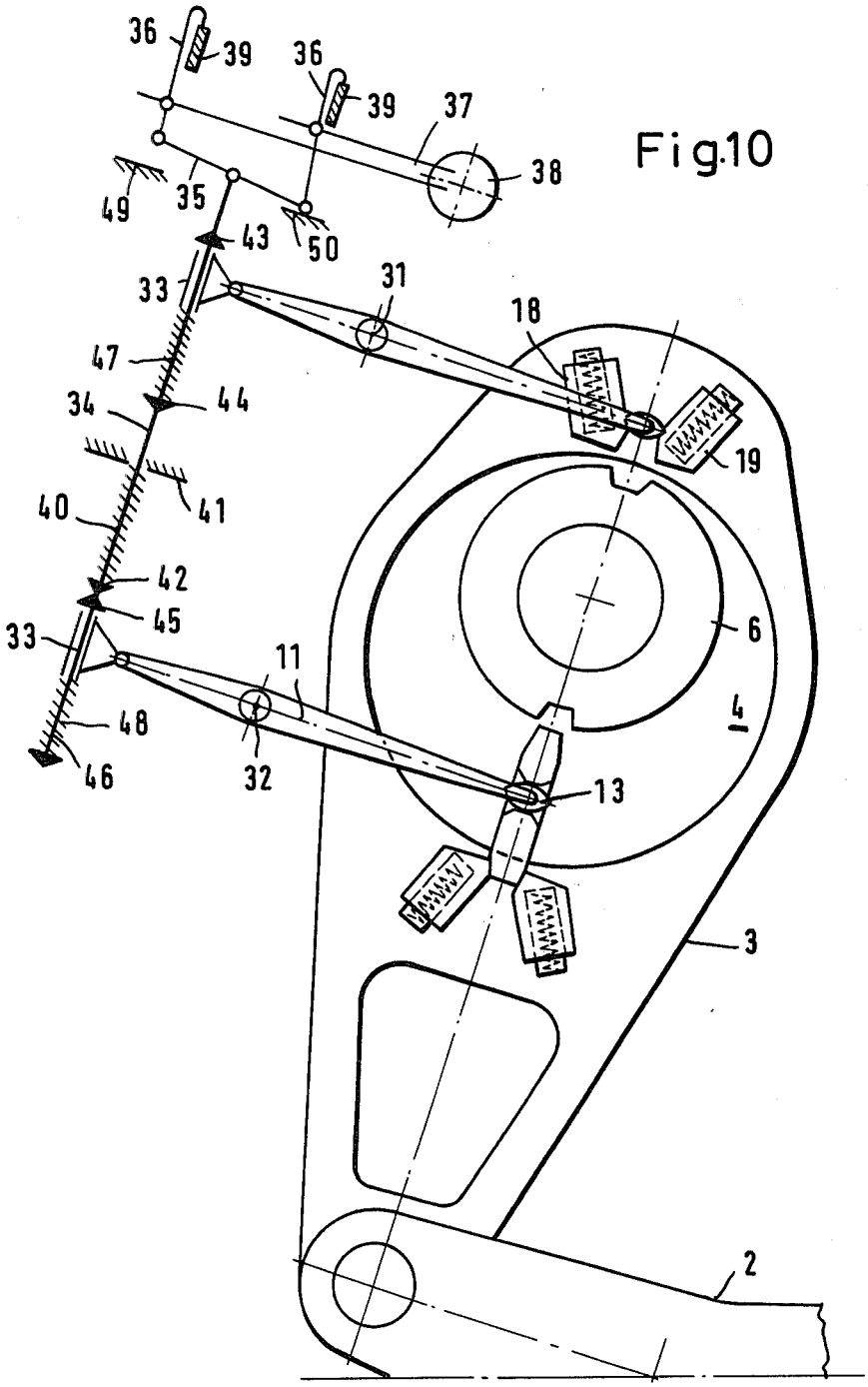

In the upper shed position shown in FIG. 10 a hole in the paper card has causes the key 5 to be disengaged and forced by the shift rod 11 into its locked position. The corresponding heddle then remains in the upper shed.

Figure 11:
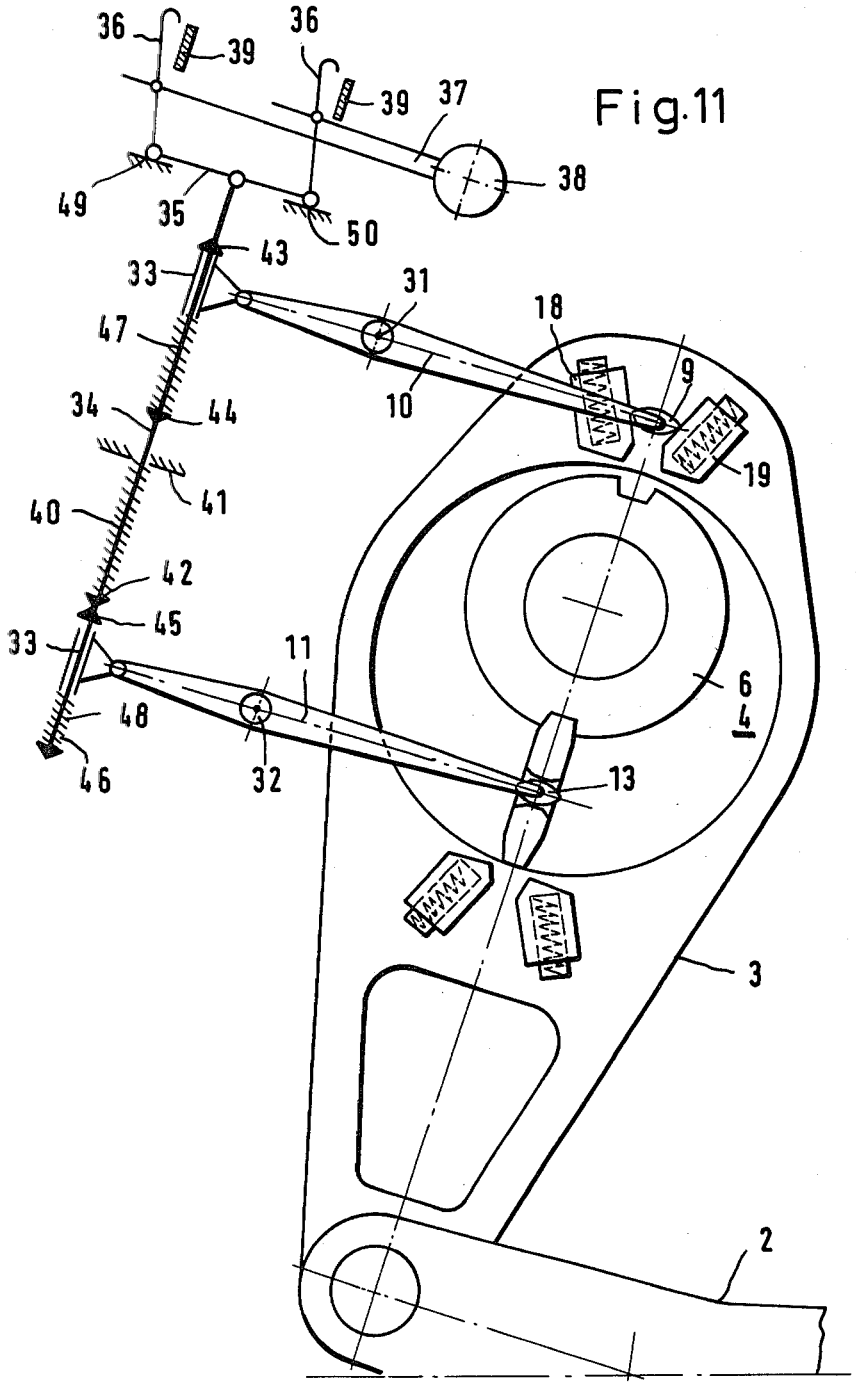

In the upper shed position shown in FIG. 11, the sensing needles 37 have not found a hole in the paper card. The two sinkers remain outside the region of motion of the knives 39 so that the balance lever 35 rests on the abutments 49 and 50, whereby the shift rod 11 couples the key 5 again in the drive shaft 6. The corresponding heddle is then moved out of the upper shed into the lower shed.

Figure 12:
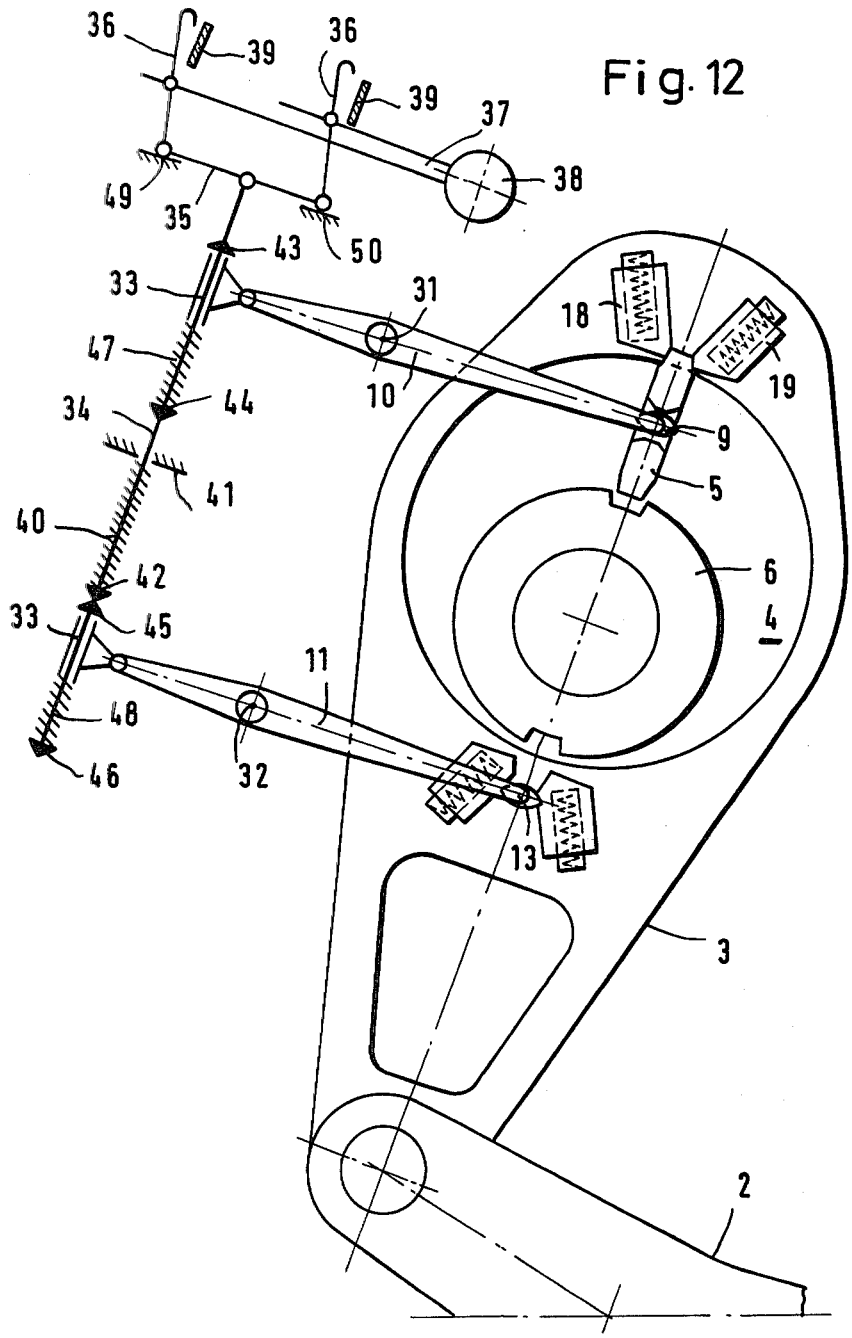

In the lower shed position shown in FIG. 12, the two sensing needles 37 have again not found any hole in the paper card so that the control remains in the position previously described and the key 5 is thereby disengaged by the shift rod 10 and forced into its locked position. The corresponding heddle remains in the lower shed upon the following operating cycle.

All new features mentioned in the specification and shown in the drawing are essential to the invention, even if they have not been expressly included in the claims.

We claim:

1. In a rotation dobby having a key coupling between a drive shaft and an eccentric device for a heddle movement in which the key is mounted under spring action in a radially extending recess in an eccentric disc arranged in a crank arm and is engageable and disengageable, in accordance with a pattern, into and out of an axially extending groove of the drive shaft at two diametrically opposite coupling positions by means of a shift rod which is controllable in accordance with a pattern and engages via a coupling member into a groove of the key, the latter being open in the axial direction of the drive shaft, the improvement including compression spring means for pressing the key in an engaged position thereof into said groove of the drive shaft with a pressing force greater than the centrifugal force acting on the key during rotation of the drive shaft, two spring-biased lock slides arranged on each said crank arm at each said coupling position, said two spring-biased lock slides constitute means for receiving an outer end of said key therebetween in a disengaged position of the key.

2. The rotation dobby according to claim 1, wherein said key is moveably mounted defining a coupling direction, each of said lock slides are moveably mounted in a direction of movement thereof which forms an angle of 3 degrees to 95 degrees with the coupling direction of said key.

3. The rotation dobby according to claim 2, wherein said angle is 25 degrees.

4. The rotation dobby according to claim 1, wherein said key is moveably mounted defining a coupling direction, said lock slides are formed at a front end thereof with a slide-on surface which forms an angle of 80 degrees to 170 degrees with the coupling direction of the key.

5. The rotation dobby according to claim 4, wherein said angle is 101 degrees.

6. The rotation dobby according to claim 1, wherein said lock slides have side walls facing the key, said side walls are beveled, the outer end of the key is beveled the same as said side walls of said lock slides forming an angle of 10 degrees to 50 degrees.

7. The rotation dobby according to claim 6, wherein said angle is about 30 degrees.

8. The rotation dobby according to claim 1, wherein said crank arm is formed with recesses, said lock slides have slide-on surfaces and are arranged in said recesses in said crank arm and extend via said slide-on surfaces out of said recesses in said crank arm.

9. The rotation dobby according to claim 8, wherein each of said lock slides has an attachment means for supporting said lock slide for axial displacement in a respective of said recesses of the crank arm, said attachment means is formed with a blind bore, a compression spring is inserted in said bore.

10. The rotation dobby according to claim 1, further comprising pins fastened in said crank arm, each of said lock slides is pivotally mounted on one of said pins, respectively, each of said lock slides is formed with a blind bore, a compression spring is inserted in said bore.

11. The control for a rotation dobby according to claim 1, wherein said shift rod is connected to said coupling member, two of said shift rods are formed as double-armed levers, a control rod means for being pushed back under spring pressure into a starting position connects said double-arm levers with each other, said control rod means is supported for displacement in an axial direction, a balance lever is operatively connected to a needlework, said control rod means is operatively connected to said balance lever.

* * * * *